United States Patent [19]

Kusumoto et al.

[11] Patent Number: 4,598,990

[45] Date of Patent: Jul. 8, 1986

[54] TONER IMAGE FIXING DEVICE

[75] Inventors: Hiroshi Kusumoto, Takaishi; Yoshiyuki Uehara, Osaka, both of Japan

[73] Assignee: Mita Industrial Co., Ltd., Osaka, Japan

[21] Appl. No.: 589,933

[22] Filed: Mar. 14, 1984

[30] Foreign Application Priority Data

Mar. 28, 1983 [JP] Japan ..... 58-50371

[51] Int. Cl.[4] ..... G03G 15/20

[52] U.S. Cl. ..... 355/3 FU; 355/14 FU; 219/216

[58] Field of Search ..... 355/3 FU, 14 FU, 3 R, 355/3 SH; 219/216; 118/60

[56] References Cited

U.S. PATENT DOCUMENTS

| | | | |
|---|---|---|---|
| 3,973,844 | 8/1976 | McCarroll | 355/3 R |
| 4,050,801 | 9/1977 | McCarroll et al. | 355/3 R |
| 4,110,068 | 8/1978 | Brown et al. | 219/216 X |
| 4,154,575 | 5/1979 | Edwards et al. | 355/3 FU X |
| 4,188,109 | 2/1980 | Idenawa et al. | 355/3 FU |
| 4,232,959 | 11/1980 | Ateya et al. | 355/3 FU |
| 4,367,690 | 1/1983 | Sakaguchi et al. | 118/60 |
| 4,421,401 | 12/1983 | Kagiura et al. | 355/3 SH X |
| 4,475,804 | 10/1984 | Kanno et al. | 355/3 FU |
| 4,498,757 | 2/1985 | Lance et al. | 355/3 FU |

*Primary Examiner*—A. C. Prescott

*Attorney, Agent, or Firm*—Wenderoth, Lind & Ponack

[57] ABSTRACT

A toner image fixing device includes a driven fixing roller drivingly connected to a driving source and a rotatably mounted follower fixing roller. The follower fixing roller is mounted on a movable supporting member which is mounted for free movement between a contacting position at which the follower fixing roller is kept in press contact with the driven fixing roller and a non-contacting or non-pressing position at which the follower fixing roller is kept out of press contact with the driven fixing roller. A press-contacting control mechanism selectively holds the movable supporting member at the contacting position and the non-contacting position. The press-contacting control mechanism includes a positioning member connected to the movable supporting member via a spring and an actuating device for selectively holding the positioning member at an operating position and a non-operating position. When the positioning member is moved to the operating position, the movable supporting member is moved to the contacting position via the spring. When the positioning member is moved to the non-operating position, the movable supporting member is moved to the non-operating position via the spring.

6 Claims, 11 Drawing Figures

TONER IMAGE FIXING DEVICE

FIELD OF THE INVENTION

This invention relates to a toner image fixing device for use in electrostatic copying apparatuses and the like.

DESCRIPTION OF THE PRIOR ART

In electrostatic copying apparatuses and the like, a toner image fixing device comprising a driven fixing roller drivingly connected to a driving source and a follower fixing roller to be in press contact with the driving fixing roller has been used in order to fix a toner image formed on (or transferred to) a copying paper to its surface. The toner image is fixed to the copying paper when the copying paper carrying the toner image is passed between the driven fixing roller and the press-contacting portion of the follower fixing roller.

In this type of toner image fixing device, the follower fixing roller is preferably formed of a flexible material in order to fix the toner image well. When the follower fixing roller is formed of a flexible material and kept in press contact with the driven fixing roller even during the stopping of these rollers, a specified angular position of the follower fixing roller kept in press contact with the driven fixing roller consequently becomes deformed locally. This results in adverse effects on subsequent fixing operations. Specifically, since the force of press contact between the driven fixing roller and the follower fixing roller at this specified angular position is markedly reduced, the toner image connot be well fixed.

Various improved toner image fixing devices have been proposed in order to solve the aforesaid problem, but have not proved to be entirely satisfactory. Problems to be solved still exist in the conventional toner image fixing devices.

SUMMARY OF THE INVENTION

It is an object of this invention to provide an improved toner image fixing device in which a follower fixing roller is selectively held at a contacting position at which it is kept in press contact with a driven fixing roller and a non-contacting or non-pressing position at which it is kept out of press contact with the driven fixing roller, whereby the follower fixing roller is prevented from deformation and the device can perform a good toner image-fixing action.

According to this invention, there is provided a toner image fixing device comprising a rotatably mounted driven fixing roller drivingly connected to a driving source, a rotatably mounted follower fixing roller, a movable supporting member having mounted thereon at least one end of the follower fixing roller, the movable supporting member being mounted for free movement between a contacting position at which the follower fixing roller is kept in press contact with the driven fixing roller and a non-contacting or non pressing position at which at least a greater portion of the follower fixing roller in its longitudinal direction is kept out of press contact with the driven fixing roller, and a press contacting control mechanism for selectively holding the movable supporting member at the contacting position and the non-contacting or non-pressing position; wherein the control mechanism includes a positioning member connected to the movable supporting member through a spring means and mounted for free movement between an operating position and a non-operating position and an actuating means for selectively holding the positioning member at the operating position and the non-operating position, when the positioning member is moved to the operating position, the movable supporting member is moved to the contacting position through the spring means whereby the follower fixing roller is brought into press contact with the driven fixing roller by the elastic biasing action of the spring means, and when the positioning member is moved to the non-operating position, the movable supporting member is moved to the non-contacting or non-pressing position through the spring means, the actuating means includes a rotating input element drivingly connected to the driving source, a rotatably mounted cam element, a spring clutch means interposed between the rotating input element and the cam element, and a clutch control means adapted to be selectively held at a first restraining position and a second restraining position, and when the clutch control means is moved from the first restraining position to the second restraining position, the rotation of the rotating input element is transmitted to the cam element through the spring clutch means to rotate the cam element from a first angular position to a second angular position and the cam element acts on the positioning member to move it to the operating position, and when the clutch control means is moved from the second restraining position to the first restraining position, the cam element is rotated from the second angular position to the first angular position and the positioning member is moved to the non-operating position.

Other objects and advantages of this invention will become apparent from the following description.

DETAILED DESCRIPTION OF PREFERRED EMBODIMENTS

Embodiments of the toner image fixing device constructed in accordance with this invention are described below in detail with reference to the accompanying drawings.

Figure 1:
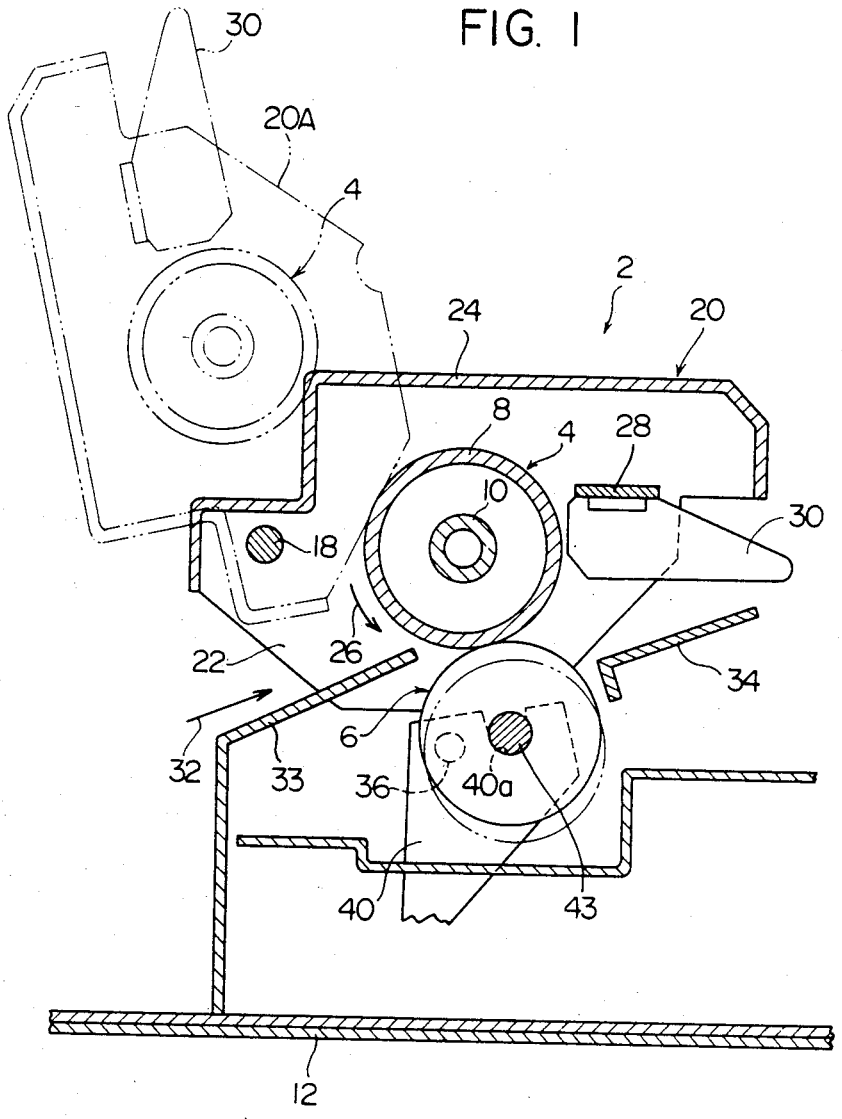
FIG. 1 is a sectional view of one embodiment of a toner image fixing device constructed in accordance with this invention as viewed from its back.

In FIG. 1 which is a simplified sectional view of the toner image fixing device, the toner image fixing device generally shown at 2 includes a driven fixing roller 4 and a follower fixing roller 6. The driven fixing roller 4 is comprised of a rotatably mounted hollow cylindrical member 8, and an electrical heating element 10 disposed within the hollow cylindrical member 8. The hollow cylindrical member 8 may be formed of a suitable metal such as an aluminum-base alloy having a suitable surface coating, such as Teflon (trademark), for effectively preventing adhesion of a toner, and the electrical heating element 10 may, for example, be a resistance heater extending longitudinally within the hollow cylindrical member 8. On the other hand, the follower fixing roller 6 supported rotatably and adapted to be kept in press contact with the driven fixing roller 4 is conveniently made of a suitable flexible material such as synthetic rubber.

The toner image fixing device 2 further has a movable supporting frame 20 mounted pivotally on a shaft member 18 fixed to and across a vertical front base plate 14 and a vertical rear base plate 16 (see FIG. 3) which are fixed at a predetermined distance therebetween to a housing 12 such as a housing in an electrostatic copying apparatus. Hence, the movable supporting frame 20 can freely pivot from a closed position shown by solid lines in FIG. 1 to an open position 20A shown by two-dot chain lines. The movable supporting frame 20 has a pair of end walls 22 (only one of which is shown in FIG. 1) and an upper wall 24. The pair of end walls 22 are spaced from each other in the front-rear direction (a direction perpendicular to the sheet surface in FIG. 1). To the movable supporting frame 20 is mounted the driven fixing roller 4. More specifically, shaft portions formed on the two ends of the hollow cylindrical member 8 of the driven fixing roller 4 are mounted rotatably on the two end walls 22 of the movable supporting frame 20. A shaft portion formed at the rear end of the hollow cylindrical member 8 projects rearwardly beyond the vertical rear base plate 16 (see FIG. 3) together with the rear end wall 22 of the movable supporting frame 20 although this is not shown in the drawings. Hence, the vertical rear base plate 16 has formed therein a recess which permits movement of the shaft portions when the movable supporting frame 20 is pivoted between the aforesaid open position and the aforesaid closed position. To this projecting end is fixed a gear drivingly connected to a driving source M (FIG. 6) such as an electric motor. Accordingly, the hollow cylindrical member 8 is rotated in a predetermined direction, i.e. the direction of an arrow 26 in FIG. 1, through the gear (not shown) upon rotation of the driving source M. A supporting plate 28 is fixed to and across the two end walls 22 of the movable supporting frame 20, and a plurality of suspended guide plates 30 are fixed to the undersurface of the supporting plate 28 at predetermined intervals in the front-rear direction (the direction perpendicular to the sheet surface in FIG. 1).

The movable supporting frame 20 further has mounted thereon a locking member (not shown) which engages a part of the vertical front base plate 14 and/or a part of the vertical rear base plate 16 to hold the movable supporting frame 20 at the closed position (the position shown by the solid lines in FIG. 1). Hence, the movable supporting frame 20 is accurately held at the closed position by pivoting it clockwise from the open position (the position 20A shown by the two-dot chain lines in FIG. 1) to engage the locking member with a part of the vertical front base plate 14 and/or a part of the vertical rear base plate 16. It can be held at the open position by releasing its engagement (locking) by the locking member and pivoting it counterclockwise from the closed position.

In the toner image fixing device 2 described above, a sheet material such as a copying paper having a toner image formed on (or transferred to) its surface is introduced into a press-contacting portion (nip position) between the driven fixing roller 4 and the follower fixing roller 6 while being guided by a guide plate 33 disposed at the inlet side of the fixing device 2 as shown by an arrow 32 in FIG. 1. While the sheet material is conveyed by the cooperative action of the driven fixing roller 4 rotated in the direction of arrow 26 and the follower fixing roller 6, the toner image is heat-fixed to the surface of the sheet material. The sheet material bearing the heat-fixed toner image is further conveyed between the suspended guide plates 30 and a guide plate 34.

It will be easily understood from FIG. 1 that a conveying passage for the sheet material in the fixing device 2 can be opened by moving the movable supporting frame 20 from the closed position to the open position and holding it there, and therefore, the driven fixing roller 4, the follower fixing roller 6, etc. can be very easily repaired, inspected and cleaned, or any sheets which may have jammed in the fixing device 2 can be very easily removed.

Figure 2:
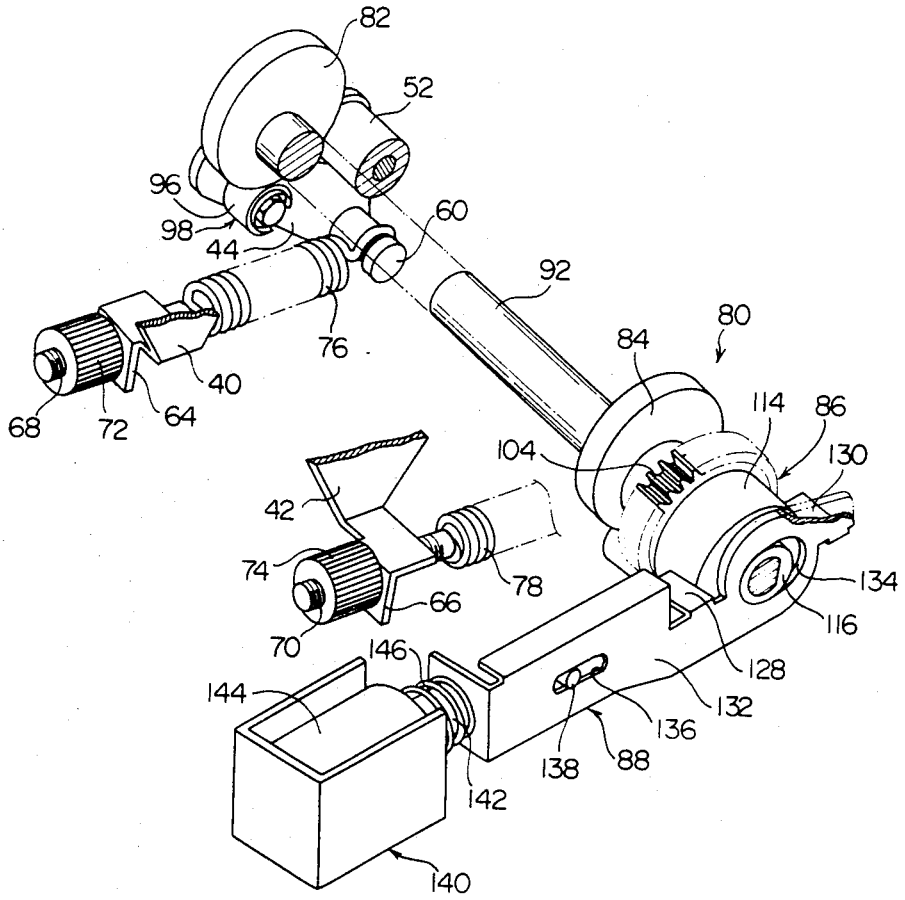
FIG. 2 is a perspective view, partly omitted and partly broken away, of a press-contacting control mechanism in the toner image fixing device of FIG. 1.

The toner image fixing device 2 is further constructed such that the follower fixing roller 6 is selectively held at a contacting position (shown by solid lines in FIG. 1) at which it is kept in press contact with the driven fixing roller 4 and a non-contacting position (shown by two-dot chain lines in FIG. 1) at which it is kept out of press contact with the driven fixing roller 4. With reference to FIGS. 2 to 6 together with FIG. 1, short shafts 36 and 38 are implanted respectively in the front surface of the vertical front base plate 14 and the rear surface of the vertical rear base plate 16 (in FIG. 1, the short shaft 36 is implanted in the vertical front base plate 14 and in FIG. 6, the short shaft 38, in the vertical rear base plate 16). Movable supporting members 40 and 42 are pivotally mounted on the short shafts 36 and 38, respectively (FIG. 1 shows the movable supporting member 40 mounted on the short shaft 36 implanted in the vertical front base plate 14, and FIG. 6 shows the movable supporting member 42 mounted on the short shaft 38 implanted in the vertical rear base plate 16. FIG. 2 shows only the lower end portions of the movable supporting members 40 and 42). Recesses 40*a* and 42*a* each of which has an open top and a semicircular lower end are formed respectively in the upper ends of the movable supporting members 40 and 42, and shaft portions 43 formed at the two ends of the follower fixing roller 6 are rotatably supported in the recesses 40*a* and 42*a*. The movable supporting members 40 and 42 are pivoted about the short shafts 36 and 38 as a center between a contacting position shown by solid lines in FIG. 1 and by two-dot chain lines in FIG. 6 (when the movable members 40 and 42 are held at the contacting position, the follower fixing roller 6 is held at the contacting position at which it is kept in press contact with the driven fixing roller 4) and a non-contacting position shown by solid lines in FIG. 6 (when the movable supporting members 40 and 42 are held at the non-contacting position, the follower fixing roller 6 is held at the non-contacting position at which it is kept out of press contact with the driven fixing roller 4) and held selectively at the contacting position and the non-contacting position.

Figure 3:
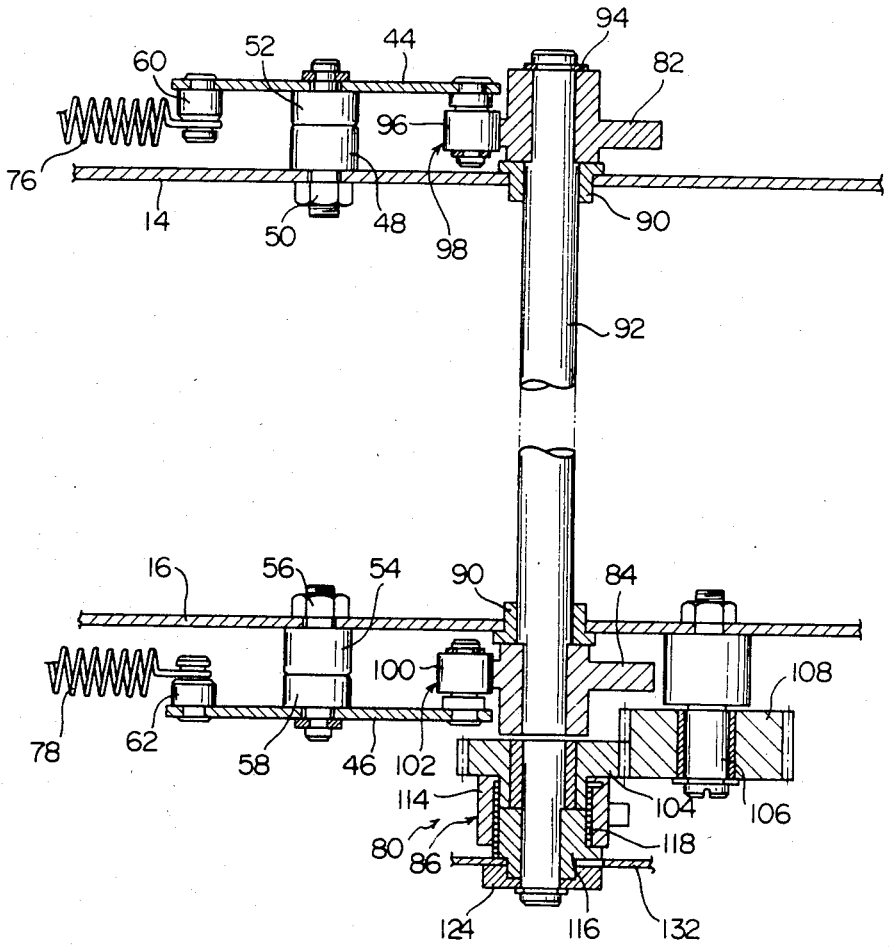
FIG. 3 is a sectional view, partly omitted, of the press-contacting control mechanism of FIG. 2.
Figure 4:
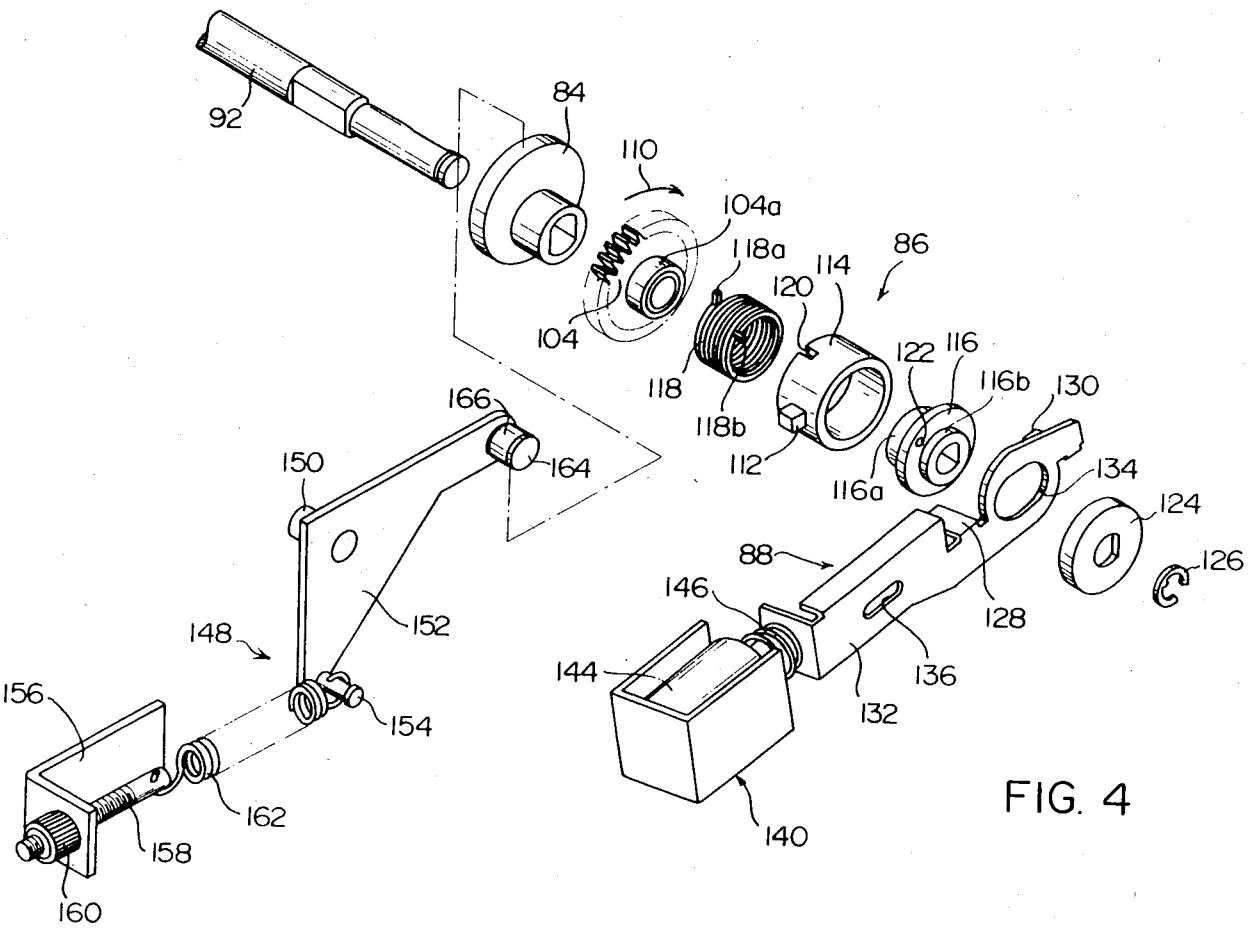
FIG. 4 is a perspective view, partly exploded, of a spring clutch means and related members in the toner image fixing device of FIG. 1.

With reference mainly to FIGS. 2 to 4, the fixing device 2 further includes a press-contacting control mechanism for selectively holding the movable supporting members 40 and 42 at the contacting position and the non-contacting position. The control mechanism comprises a pair of positioning members 44 and 46. To the vertical front plate 14 is fixed a forwardly projecting supporting shaft 48 by means of a nut 50. The positioning member 44 is pivotally mounted on the end portion of the supporting shaft 48 through a collar member 52. A rearwardly projecting supporting shaft 54 is fixed to the rear surface of the vertical rear base plate 16 by means of a nut 56. The other positioning member 46 is pivotally mounted on the end portion of the supporting shaft 54 through a collar member 58. Pins 60 and 62 are implanted in the lower end portions of the positioning members 44 and 46. On the other hand, suspension pieces 64 and 66 are formed integrally in the lower ends of the movable supporting members 40 and 42. Holes are respectively formed in the suspension pieces 64 and 66, and threaded shafts 68 and 70, each having an external thread formed on its peripheral surface at one end thereof, are inserted in these holes. Nut members 72 and 74 are screwably secured to the threaded shafts 68 and 70 for restricting the movement of the threaded shafts 68 and 70 in the right upward direction in FIG. 2 relative to the suspension pieces 64 and 66. A spring means 76 composed of a tension coil spring is stretched between the other end of the threaded shaft 68 and the pin 60 implanted in the positioning member 44, and a spring means 78 is stretched between the other end of the threaded shaft 70 and the pin 62 implanted in the positioning member 46. As will be clear from the following description, the positioning members 44 and 46 are each pivoted between an operating position shown by two-dot chain lines in FIG. 6 and a non-operating position shown by solid lines in FIG. 6, and held selectively at either the operating position or the non-operating position. When the positioning members 44 and 46 are moved from the non-operating position to the operating position, this movement is transmitted to the movable supporting members 40 and 42 through the spring means 76 and 78 whereby the movable supporting members 40 and 42 are moved from the non-contacting position to the contacting position. As a result, the follower fixing roller 6 is brought into press contact with the driven fixing roller 4 along its entire length (and therefore the follower fixing roller 6 is held at the contacting position) by the pressure defined by the spring means 76 and 78, as can be easily understood from FIGS. 1 and 6. The press-contacting force generated by the spring means 76 and 78 can be properly adjusted by operating the nut members 72 and 74. On the other hand, when the positioning members 44 and 46 are brought to the non-operating position from the operating position, this movement is transmitted to the movable supporting members 40 and 42 through the spring members 76 and 78 to move the movable supporting members 40 and 42 from the contacting position to the non-contacting position. It will be easily seen from FIGS. 1 and 6 that as a result, the follower fixing roller 6 is completely moved away from the driven fixing roller 4 along its entire length (and therefore, the follower fixing roller 6 is held at the non-contacting position).

The positioning members 44 and 46 are selectively held at the operating position or the non-operating position by an actuating means generally shown at 80 (FIG. 2).

The actuating means 80 comprises a pair of eccentric cam plates 82 and 84 (constituting a cam element), a spring clutch means 86 and a clutch control means 88. A shaft 92 is rotatably mounted by bearing members 90 in the vertical front base plate 14 and the vertical rear base plate 16 which are fixed to the housing 12 (FIG. 1). One end portion of the shaft 92 extends through the vertical front base plate 14 and projects forwardly (upwardly in FIG. 3), and the eccentric cam plate 82 is mounted on the projecting portion of the shaft 92. In the illustrated embodiments, as shown in FIG. 3, the eccentric cam plate 82 having a hole with a shape corresponding to the cross sectional shape of one end portion of the shaft 92 fits over such end of the shaft 92, and thereafter, a stopping member 94 is secured to such end of the shaft 92. As a result, the eccentric cam plate 82 is mounted on the one end portion of the shaft 92, and therefore rotates as a unit with the shaft 92. In relation to the eccentric cam plate 82, a cam follower member 98 having a roller 96 rotatably mounted on its free end portion is fixed to the positioning member 44 mounted pivotally on the vertical front base plate 14. The roller 96 of the cam follower member 98 is elastically pressed against the circumferential surface of the eccentric cam plate 82 by the action of the spring means 76 stretched between the pin 60 implanted in the positioning member 44 and the suspension piece 64 of the movable supporting member 40. The other end portion of the shaft 92 extends through the vertical rear base plate 16 and projects rearwardly (downwardly in FIG. 3), and the eccentric cam plate 84 is mounted on this projecting end portion. In the illustrated embodiment, as shown in FIGS. 3 and 4, the eccentric cam plate 84 having a hole with a shape corresponding to the cross-sectional shape of the other end portion of the shaft 92 fits over such other end portion of the shaft 92 having an engaging surface. As a result, the eccentric cam plate 84 is mounted on such the other end portion of the shaft 92, and rotates as a unit with the shaft 92. In relation to the eccentric cam plate 84, a cam follower member 102 having a roller 100 rotatably mounted on its free end portion is fixed to the positioning member 46 mounted pivotally on the vertical rear base plate 16. The roller 100 of the cam follower member 102 is elastically pressed against the circumferential surface of the eccentric cam plate 84 by the action of the spring member 78 stretched between the pin 62 implanted in the positioning member 46 and the suspension piece 66 of the movable supporting member 42. A gear 104 constituting a rotating input element is further rotatably mounted rearwardly (outwardly) of the mounting position of the eccentric cam plate 84 on the other end portion of the shaft 92 having the eccentric cam plate 84 mounted thereon. The gear 104 is in mesh with a gear 108 rotatably mounted on a short shaft 106 fixed to the rear surface of the vertical rear base plate 16. The gear 108 is drivingly connected to the driving source M (FIG. 6) such as an electric motor through a suitable drive transmission means (not shown). Hence, when the driving source M is driven, the gear 104 is rotated in the direction of an arrow 110 (FIG. 4) via the gear 108. The driving force of the gear 104 is transmitted to the cam plates 82 and 84 through the spring clutch means 86. With reference mainly to FIGS. 3 and 4, the spring clutch means 86 includes a restrained rotating member 114 having an engaging claw 112 formed on its peripheral surface, a member 116 having hub portions 116*a* and 116*b* formed on its opposite surfaces, and a coil spring 118. The member 116 is mounted on that position of the other end portion of the shaft 92 which is rearwardly (outwardly) of the mounting position of the gear 104. More specifically, the member 16 having a hole with a shape corresponding to the cross-sectional shape of the other end portion of the shaft 92 is fit over the other end portion of the shaft 92 having an engaging surface. As a result, the member 116 is mounted on the other end portion of the shaft 92 and thus rotates as a unit with the shaft 92. The coil spring 118 is fitted over a hub portion 104*a* formed in the gear 104 and the hub portion 116*a* of the member 116. The restrained rotating member 114 is received about the coil spring 118. The coil spring 118 is turned in the right direction as viewed from right bottom in FIG. 4, and its one end 118*a* is inserted in a slit 120 formed in the restrained rotating member 114 and thus fixed to the restrained rotating member 114. Its other end 118*b* is inserted in a hole 122 formed in the member 116 and thus fixed to the member 116. A fixing member 124 and a stop member 126 are mounted on the other end of the shaft 92 in order to prevent detachment of the eccentric cam plate 84, the gear 104 and the member 116 from the shaft 92. More specifically, over the other end of the shaft 92 having an engaging surface, the fixing member 124 having a hole with a shape corresponding to the sectional shape of the other end of the shaft 92 is fit and thus mounted on the other end of the shaft 92. Furthermore, the stop member 126 is mounted on the other end of the shaft 92 by fitting it in a groove fromed in the other end of the shaft 92.

In relation to the clutch means 86, a clutch control means 88 is disposed as shown in FIGS. 2 and 4. The clutch control means 88 includes a control member 132 having a first engaging piece 128 and a second engaging piece 130, and an elongate hole 134 formed at one end portion of the control member 132 is received slidably by the hub portion 116*b* of the member 116. A narrow elongate hole 136 is formed in the middle part of the control member 132, and a pin 138 implanted in the vertical rear base plate 16 (FIG. 3) is inserted in the narrow elongate hole 136. The other end of the control member 132 is connected to an output shaft 142 of an electromagnetic solenoid 140 mounted on the rear surface of the vertical rear base plate 16, and a spring member 146 is interposed between the main body 144 of the electromagnetic solenoid 140 and the other end of the control member 132. When the electromagnetic solenoid 140 is deenergized, the elastic biasing action of the spring member 146 holds the control member 132 at a first restraining position shown in FIG. 2 and by solid lines in FIG. 5 (when the control member 132 is held at the first restraining position, one end of the elongate hole 134 formed in the control member 132 contacts the hub portion 116*b* of the member 116). When the electromagnetic solenoid 140 is energized, the control member 132 is moved to the left in FIG. 5 against the elastic biasing action of the spring member 46 and held at a second restraining position shown by two-dot chain lines in FIG. 5 (when the control member 132 is held at the second restraining position, the other end of the elongate hole 134 formed in the control member 132 contacts the hub portion 116*b* of the member 116). When the control member 132 is held at the first position, the engaging claw 112 formed in the restrained rotating member 114 becomes engageable with the under surface of the first stop piece 128 formed in the control member 132 (at this time, the second stop piece 130 formed in the control member 132 is deviated from the moving path of the engaging claw 112 of the restrained rotating member 114), as can be easily understood from FIG. 5. When the engaging claw 112 engages the undersurface of the first stop piece 128, the restrained rotating member 114 is held at a first restrained angular position shown by solid lines in FIG. 5 (when the restrained rotating member 114 is held at the first restrained angular position, the eccentric cam plates 82 and 84 are held at a first angular position shown by solid lines in FIG. 6 in the manner to be described), and the rotation of the restrained rotating member 114 beyond the first restrained angular position is hampered. On the other hand, when the control member 132 is held at the second restraining position, the engaging claw 112 of the restrained rotating member 114 becomes engageable with the upper surface of the second stop piece 130 formed in the control member 132 (at this time, the first stop piece 128 of the control member 132 is deviated from the moving path of the engaging claw 112), as can be easily understood from FIG. 5. When the engaging claw 112 engages the upper surface of the second stop piece 130, the restrained rotating member 114 is held at a second restrained angular position shown by two-dot chain line in FIG. 5 (when the restrained rotating member 114 is held at the second restrained angular position, the eccentric cam plates 82 and 84 are held at a second angular position shown by two-dot chain lines in FIG. 6 in the manner to be described), and the rotation of the restrained rotating member 114 beyond the second restrained angular position is hampered.

The press-contacting control mechanism described above further includes a braking means shown generally at 148 which is disposed in relation to the eccentric cam plate 84 described above, as shown in FIG. 4. The braking means 148 has an oscillating member 152 which is oscillatably mounted on a short shaft 150 implanted in the rear surface of the vertical rear base plate 16 (FIG. 3). A pin 154 is implanted in one end of the oscillating member 152. On the other hand, a fitting bracket 156 having a hole formed therein is fixed to the rear surface of the vertical rear base plate 16, and a threaded shaft 158 having an external thread formed on its peripheral surface is inserted in the hole of the fitting bracket 156. A nut member 160 is screwably secured to the threaded shaft 158 to restrict the right upward movement of the screw shaft 158 in FIG. 4. A tension coil spring 162 is stretched between the other end of the threaded shaft 158 and the pin 154 implanted in the oscillating member 152. A short shaft 64 is further fixed to the other end of the oscillating member 152, and a roller 166 is rotatably mounted on the short shaft 164. It will be easily appreciated from FIG. 4 that the roller 166 of the braking means 148 is elastically pressed against the circumferential surface of the eccentric cam plate 84 by the action of the tension coil spring 162. The rotation braking force of the tension coil spring 162 is properly adjusted by operating the nut member 160, and as will be described later, set at a value lower than the elastic rotating force to be applied to the eccentric cam plates 82 and 84 by the tension coil springs 76 and 78. The braking member 148 can also be constructed such that the roller 166 is pressed elastically against the eccentric cam plate 82 and the positioning members 44 and 46.

When the toner image fixing device 2 having the structure described above is used, for example, as a fixing device in an electrostatic copying machine, the electromagnetic solenoid 140 for moving the control member 132 is energized simultaneously with the actuation of the driving source M (FIG. 6) such as an electric motor by starting a copying process (usually by depressing a print button), and deenergized simultaneously with the stopping of the actuation of the driving source M by completion of the copying process (or it is energized before the starting of the toner image fixing action after the start of the copying process, and deenergized after the end of the toner image fixing action). To prevent the aforesaid deformation which may occur in the follower fixing roller 6, it is important that the electromagnetic solenoid 140 should be in the deenergized state at least while the driving source M is in the deenergized state. This prevents a specified angular position of the follower fixing roller 6 from being kept in press contact with the driven fixing roller 4, as will be described hereinafter.

The operation and advantages of the toner image fixing device 2 having the aforesaid press contacting control mechanism will be described below with reference mainly to FIGS. 2, 3 and 6. When the electromagnetic solenoid 140 is energized, the control member 132 is brought from the first restraining position shown in FIG. 2 and by the solid lines in FIG. 5 to the second restraining position shown by the two-dot chain lines in FIG. 5 against the elastic biasing action of the spring member 146, whereby the first stop piece 128 formed in the control member 132 is kept out of engagement with the engaging claw 112 formed in the restrained rotating member 114. As a result, the coil spring 118 is contracted by the rotation of the gear 104 which is rotated in the direction of an arrow 110 (FIG. 4) by the driving force transmitted from the driving source M, whereby the hub portion 104*a* of the gear 104 is connected to the hub portion 116*a* of the member 116 by the coil spring 118, and the member 116 is also rotated in the same direction as the rotating direction of the gear 104 (i.e. in the direction of arrow 110 in FIG. 4). When the member 116 is rotated, the restrained rotating member 114 connected by the coil spring 118 is also rotated in the same direction as the rotating direction of the gear 104 (at this time, the eccentric cam plates 82 and 84 mounted on the shaft 92 are also rotated in the same direction as the rotating direction of the gear 104). When the restrained rotating member 114 is rotated, the engaging claw 112 formed therein contacts the upper surface of the second stop piece 130 formed in the control member 132 as shown by the two-dot chain lines in FIG. 5, thereby hampering the contraction of the coil spring 118 and releasing the above state of connection of the hub portion 104*a* and the hub portion 116*a* by the coil spring 118. Thus, the rotation of the restrained rotating member 114 and the member 116 connected by the coil spring 118 is hampered, and the restrained rotating member 114 is held at the second restrained angular position shown by the two-dot chain lines in FIG. 5. When the restrained rotating member 114 is held at this position, the rotation of the shaft 92 and the eccentric cam plates 82 and 84 is also stopped in relation to the member 116, and the eccentric cam plates 82 and 84 are held at the second angular position shown by the two-dot chain lines in FIG. 6. When the eccentric cam plates 82 and 84 are held at the second angular position, it will be seen from FIG. 6 that the large-diameter portions of the cam plates 82 and 84 act on the rollers 96 and 100 of the cam follower members 98 and 102 respectively, and consequently, the positioning members 44 and 46 to which the cam follower members 98 and 102 are fixed respectively are held at the operating position shown by the two-dot chain lines in FIG. 6. When the positioning members 44 and 46 are held at this operating position, the movable supporting members 40 and 42 are held at the contacting position shown in FIG. 1 and by the two-dot chain lines in FIG. 6 via the spring means 76 and 78, and the follower fixing roller 6 is brought into press contact with the driven fixing roller 4 along its entire length by the action of the spring means 76 and 78 (and therefore, the follower fixing roller 6 is held at the contacting position shown by the solid lines in FIG. 1 and the two-dot chain lines in FIG. 6).

Figure 5:
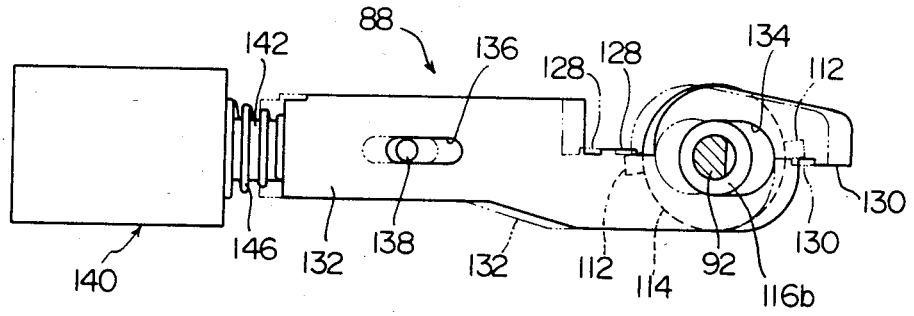
FIG. 5 is an enlarged view illustrating the action of a clutch control means in the toner image fixing device of FIG. 1.
Figure 6:
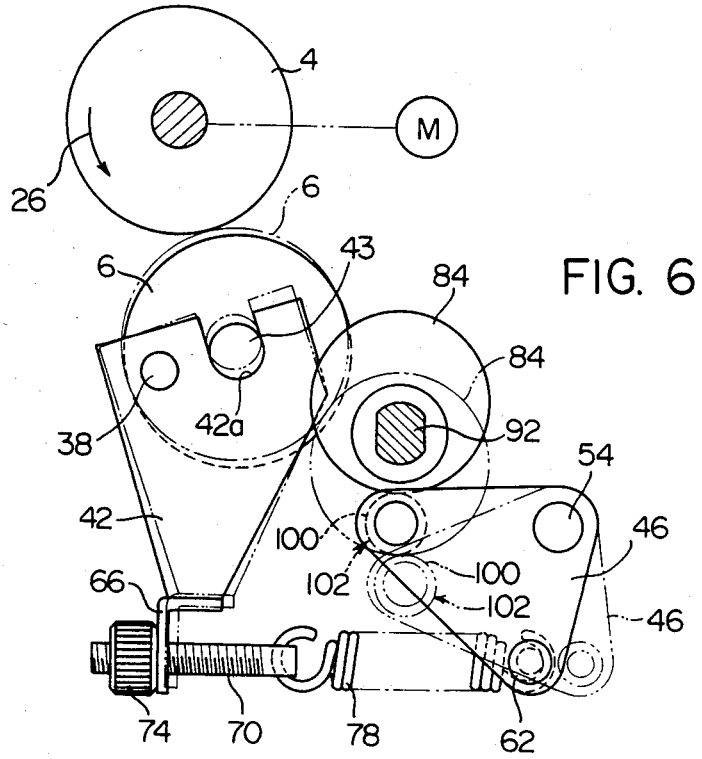
FIG. 6 is an enlarged view illustrating the action of a part of the press-contacting control mechanism of FIG. 2.

Now, when the electromagnetic solenoid 140 is deenergized, the control means 132 is brought from the second restraining position shown by the two-dot chain lines in FIG. 5 to the first restraining position shown by the solid lines in FIG. 5 by the elastic biasing action of the spring member 146, and the second stop piece 130 formed in the control member 132 is disengaged from the engaging claw 112 formed in the restrained rotating member 114. As a result, the coil spring 118 is contracted by the rotation of the gear 104 which is rotated in the direction of arrow 110 (FIG. 4) by the driving force transmitted from the driving source M, and the hub portion 104*a* of the gear 104 is connected to the hub portion 116*a* of the member 116. Thus, the member 116 is also rotated in the same direction as the rotating direction of the gear 104, i.e. in the direction of arrow 110 (FIG. 4) (when the electromagnetic solenoid 140 and the driving source M are simultaneously deenergized, the operation is somewhat different from the operation described below, and therefore will be described in detail hereinafter). When the member 116 is rotated, the restrained rotating member 114 connected by the coil spring 118 is also rotated in the same direction as the rotating direction of the gear 104 (at this time, the eccentric cam plates 82 and 84 are also rotated as described above). When the restrained rotating member 114 is rotated, the engaging claw 112 formed in the restrained rotating member 114 contacts the undersurface of the first stop piece 128 formed in the control member 132 as shown by the solid lines in FIG. 5, thereby hampering the contraction of the coil spring 118 and releasing the state of connection of the hub portion 104*a* and the hub portion 116*a* by the coil spring 118. Consequently, the rotation of the restrained rotating member 114 and the member 116 connected by the spring member 118 is hampered, and the restrained rotating member 114 is held at the first restrained angular position. When the restrained rotating member 114 is held at this position, the rotation of the shaft 92 and the eccentric cam plates 82 and 84 are also stopped in relation to the member 116, and the eccentric cam plates 82 and 84 are held at the first angular position shown by the solid lines in FIG. 6. It will be appreciated from FIG. 6 that when the eccentric cam plates 82 and 84 are held at the first angular position, the small-diameter portions of the cam plates 82 and 84 act respectively on the rollers 96 and 100 of the cam follower members 98 and 102, and therefore, the positioning members 44 and 46 to which the cam follower members 98 and 102 are fixed are positioned at the non-operating position shown by the solid lines in FIG. 6. When the positioning members 44 and 46 are held at the non-operating position, the movable supporting members 40 and 42 are brought to the non-contacting position shown by the solid lines in FIG. 6 via the spring means 76 and 78, and the follower fixing roller 6 is kept completely away from the driving fixing roller 4 along its entire length (and therefore, the follower fixing roller 6 is held at the non-contacting position shown by the two-dot chain lines in FIG. 1 and the solid lines in FIG. 6 at which it is kept out of press contact with the driven fixing roller 4).

When the electromagnetic solenoid 140 and the driving source M are simultaneously deenergized (for example, when the toner image fixing device 2 described above is applied to an electrostatic copying machine, the electromagnetic solenoid 140 and the driving source M are constructed such that they are simultaneously deenergized when sheet jamming occurs in a sheet conveying passage of the electrostatic copying machine), the control member 132 is held at the first restraining position in the manner described above, and in relation to it, the cam plates 82 and 84 are turned slightly in the rotating direction shown by arrow 110 (FIG. 4) by the rotation of the gear 104 rotating by the inertia of the driving source M. It will be appreciated from FIG. 6 that consequently, an elastic rotating force to rotate the eccentric cam plate 82 and 84 clockwise in FIG. 6 acts on these cam plates via the positioning members 44 and 46 by the elastic biasing action of the spring means 76 and 78. Since this elastic rotating force is larger than the rotating braking force exerted on the eccentric cam plate 84 by the braking means 148, the elastic rotating force rotates the eccentric cam plates 82 and 84 clockwise in FIG. 6. As a result, with the pivotal movement of the positioning member 44 and 46, the cam plates 82 and 84 are rotated, and the positioning members 44 and 46 are held at the non-operating position shown by the solid lines in FIG. 6. Also, the eccentric cam plates 82 and 84 are held at the first angular position shown by the solid lines in FIG. 6. Consequently, the follower fixing roller 6 is completely kept away from the driven fixing roller 4, and the restrained rotating member 114 connected to the member 116 by the coil spring 118 is rotated in the same direction as the rotating direction of the eccentric cam plates 82 and 84, that is, clockwise as viewed from right bottom in FIG. 2. As a result, the engaging claw 112 formed in the restrained rotating member 114 contacts the undersurface of the first stop piece 128 of the control member 132 at the first restraining position to hold the restrained rotating member 114 at the first restrained angular position. When the restrained rotating member 114 is rotated in the manner mentioned above, the coil spring 118 is expanded by the force transmitted to the restrained rotating member 114 from the member 116, and therefore, the gear 104 drivingly connected to the driving source M by the coil spring 118 is not rotated.

One specific example of the toner image fixing device 2 constructed in accordance with this invention has been described hereinabove with reference to FIGS. 1 to 6. It is possible, if desired, to use a press-contacting control mechanism of the type shown in FIGS. 7 to 10 instead of the press-contacting control mechanism in the above embodiment.

Figure 7:
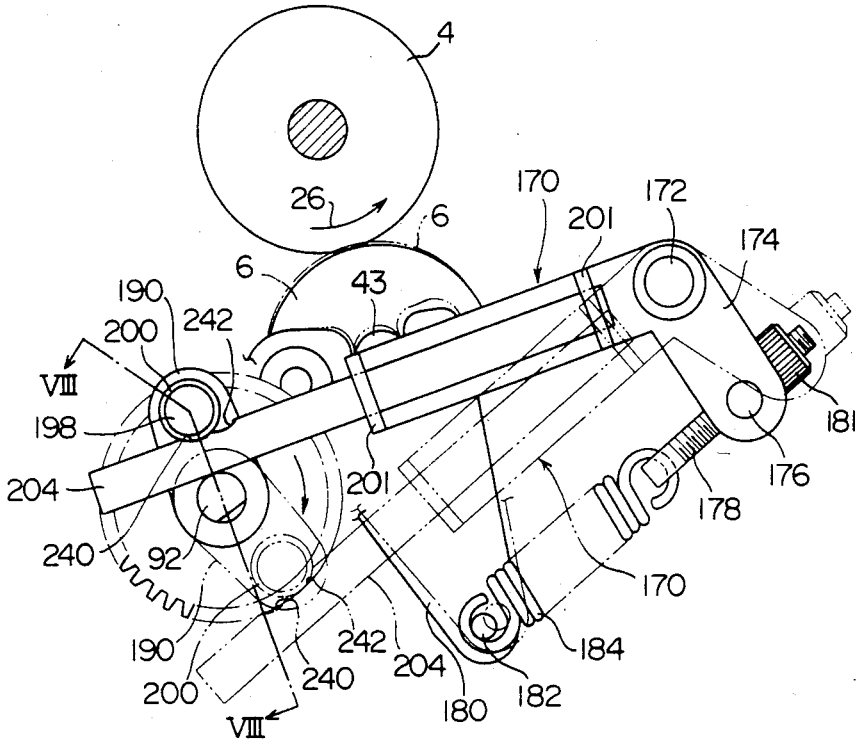
FIG. 7 is a rear view, partly omitted and partly broken away, of a modified example of the press-contacting control mechanism.
Figure 8:
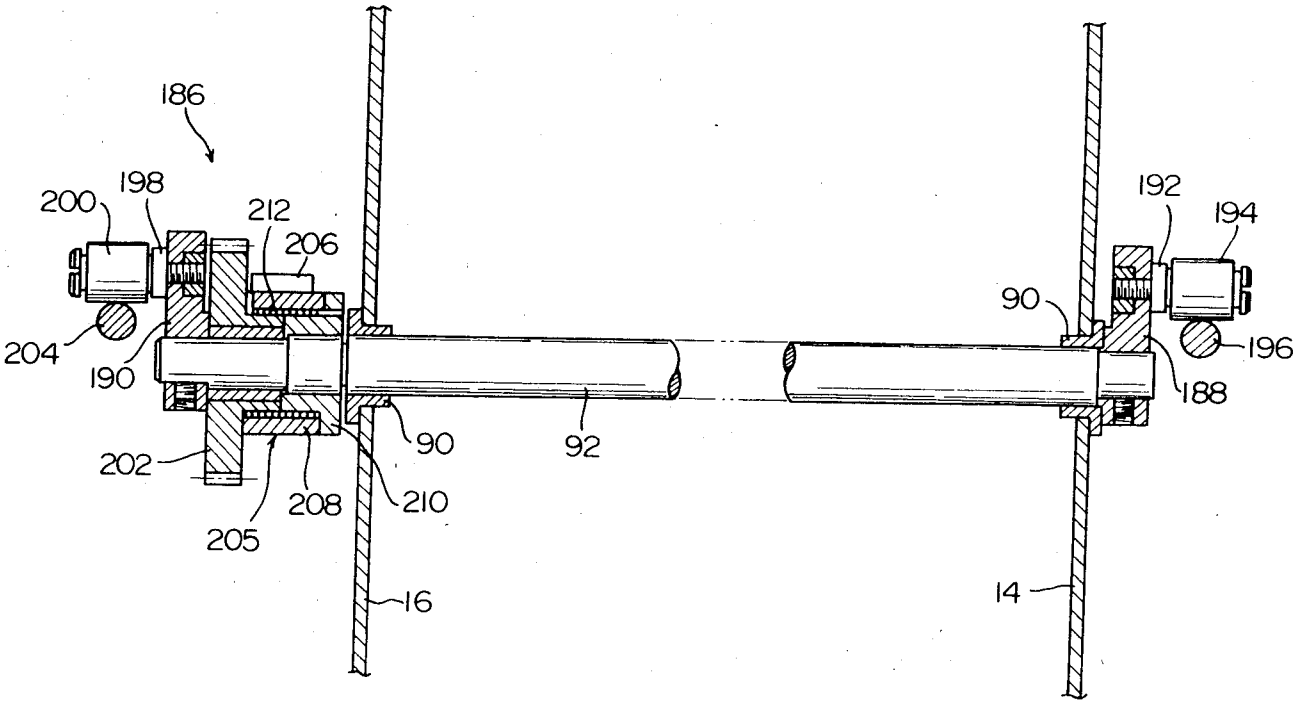
FIG. 8 is a sectional view taken along line VIII—VIII in FIG. 7.

With reference to FIGS. 7 to 10 showing a modified example of the press-contacting control mechanism, the press-contacting control mechanism includes a pair of positioning members 170 (only one of which is shown in FIG. 7). A rearwardly projecting supporting shaft 172 is fixed to the rear surface of the vertical rear base plate 16 (FIG. 8). One positioning member 170 is pivotally mounted on one end portion of the supporting shaft 172. A supporting shaft (not shown) is fixed to the front surface of the vertical front base plate 14, and the other positioning member 170 is pivotally mounted on one end portion of the supporting shaft. With reference to FIG. 7, the positioning member 170 has an L-shaped oscillating body 174. The oscillating body 174 is formed in a ]-shaped cross section, and a member 176 having a through-hole formed therein (only its fixed end portion is shown in FIG. 7) is fixed to, and across, both side walls at one end portion of the oscillating body 174. A threaded shaft 178 having an external thread formed on its peripheral surface is inserted into the through-hole (not shown) of the member 176. A nut member 181 is screwably secured to the threaded shaft 178 so as to restrict the left downward movement of the threaded shaft 178 in FIG. 7 relative to a movable supporting member 180 having the follower fixing roller 6 rotatably supported thereon (FIG. 7 only shows the movable supporting member 180 supporting a shaft portion 43 formed at the rear end of the follower fixing roller 6). A spring means 184 composed of a tension coil spring is stretched both between the threaded shaft 178 and a pin 182 implanted in the movable supporting member 180 disposed in the vertical rear base plate 16 and between the threaded shaft 178 and a pin (not shown) implanted in the movable supporting member 180 disposed in the vertical front base plate 14 (only one spring means 184 is shown in FIG. 7). As will be made clear from the following description, the positioning members 170 are each pivoted between a non-operating position shown by solid lines in FIG. 7 and an operating position shown by two-dot chain line in FIG. 7, and selectively held at the operating position or the non-operating position. When the positioning members 170 are held at the operating position, the movable supporting members 180 are held at a contacting position shown by two-dot chain line in FIG. 7 via the spring means 184. It will be easily appreciated from FIG. 7 that as a result, by the pressure defined by the spring means 184, the follower fixing roller 6 is brought into press contact with the driven fixing roller 4 (and therefore, the follower fixing roller 6 is held at a contacting position shown by two-dot chain lines in FIG. 7). In this modified example, the press-contacting force due to the spring means 184 can be properly adjusted by operating the nut member 181. On the other hand, when the positioning members 170 are held at the non-operating position, the movable supporting members 180 are brought to a non-operating position shown by solid lines in FIG. 7 via the spring means 184. Consequently, as is seen from FIG. 7, the follower fixing roller 6 is brought into rolling contact with the driven fixing roller 4 along its entire length, and therefore the follower fixing roller 6 is held at the non-contacting position shown by the solid lines in FIG. 7. (In the embodiment shown in FIGS. 1 to 6, the follower fixing roller 6 is adapted to be completely kept away from the driven fixing roller 4 at the non-contacting position In the modified example shown in FIGS. 7 to 10, the follower fixing roller 6 is kept in rolling contact with the driven fixing roller 4, and is rotated with the rotation of the latter. But that part of the roller 6 which makes contact with the roller 4 is not substantially deformed).

Figure 9:
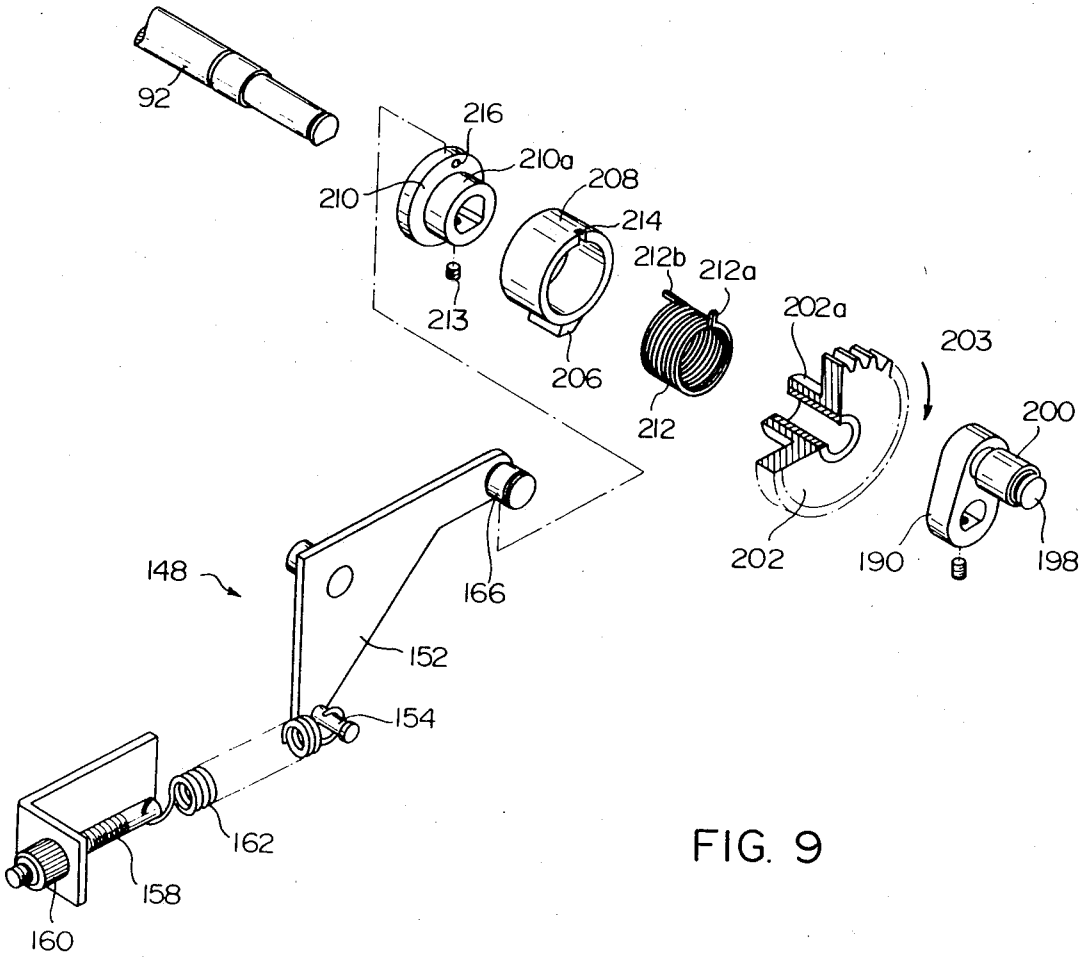
FIG. 9 is a perspective view, partly exploded, of a spring clutch means and related members in the press contacting control mechanism of FIG. 7.
Figure 10:
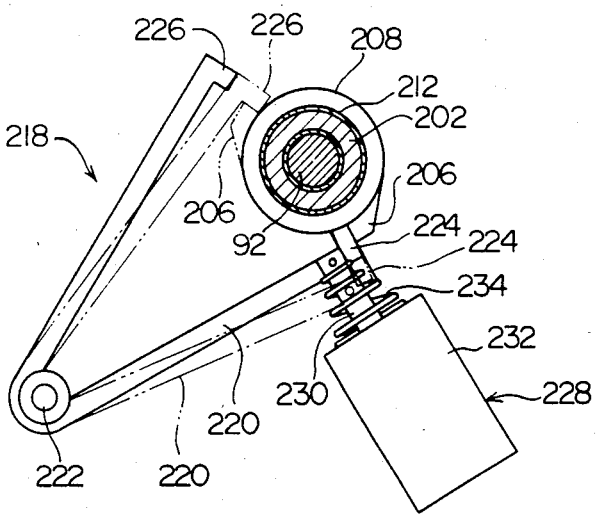
FIG. 10 is an enlarged view illustrating the action of a clutch control means in the press-contacting control mechanism of FIG. 7.

The positioning members 170 are selectively held at the operating position or the non-operating postion by an actuating means shown generally at 186. With reference to FIGS. 8 and 9, the actuating means 186 includes a pair of rotating members 188 and 190. The shaft 92 is rotatably mounted by bearing members 90 to the vertical front base plate 14 and the vertical rear base plate 16 (FIG. 8) fixed to the housing. One end portion of the shaft 92 extends through the vertical front base plate 14 and further projects forwardly (to the right in FIG. 8), and the rotating member 188 is fixed to the projecting portion of the shaft 92 by a securing screw. A short shaft 192 is fixed to the front surface of the rotating member 188, and a roller 194 is rotatably mounted on one end portion of the short shaft 192. The rotating member 188 and the roller 194 act as a cam element as will be made clear from the following description. In relation to this cam element, a rod member 196 (only a part of which is shown in FIG. 8) acting as a cam follower member is fixed to the outside projecting portion of the oscillating body 174 of the positioning member 170 mounted pivotally on the vertical front base plate 14. The upper end of the rod member 196 is elastically pressed against the undersurface of the roller 194 mounted on the rotating member 188 by the action of the spring means 184 stretched between one end portion of the positioning member 170 mounted on the vertical front base plate 14 and a pin implanted in the movable supporting member 180. The other end portion of the shaft 92 extends through the vertical rear base plate 16 and projects rearwardly (to the left in FIG. 8), and the other rotating member 190 is fixed to the projecting end portion of the shaft 92 by a securing screw. A short shaft 198 is fixed to the rear surface of the rotating member 190, and a roller 200 is rotatably mounted on the forward end portion of the shaft 198. The rotating member 190 and the roller 200 also act as a cam element as will become clear from the following description. In relation to the cam element, a rod member 204 (shown in FIG. 7 and a part of it is shown in FIG. 8) acting as a cam follower member is fixed to the outside projecting portion 201 of the oscillating body 174 mounted on the vertical rear base plate 16. The upper end of the rod member 204 is elastically pressed against the undersurface of the roller 200 mounted on the rotating member 190 by the action of the spring means 184 stretched between one end portion of the positioning member 170 mounted on the vertical rear base plate 16 and the pin 182 implanted in the movable supporting member 180. A gear 202 (constituting a rotating input element) and a spring clutch means 205 which constitute part of the actuating means 186 are also mounted on the other end portion of the shaft 92. With reference to FIGS. 8 and 9, the gear 202 is rotatably mounted on that part of the shaft 92 which is inwardly of the mounting position of the rotating member 190, and the spring clutch means 205 is disposed inwardly of the mounting position of the gear 202. The gear 202 adapted to be rotated in the direction shown by an arrow 203 is drivingly connected to a driving source (not shown) such as an electric motor via a suitable drive transmission means (not shown). The spring clutch means 205 comprises a restrained rotating member 208 having an engaging claw 206 on its peripheral surface, a disc-like member 210 having a hub portion **210*a* formed on one surface, and a coil spring 212. The disc-like member 210 is fixed by a securing screw 213 to that part of the other end portion of the shaft 92 which is inwardly of the mounting position of the gear 202, and the coil spring 212 is fitted over and across the hub portion 210*a* formed in the member 210 and a hub portion 202*a* formed on the side surface of the gear 202. The restrained rotating member 208 is received about the coil spring 212. The coil spring 212 is wound in the right direction as viewed from right bottom in FIG. 9, and its one end 212*a* is fixed to the restrained rotating member 208 by being inserted into a slit 214 formed in the restrained rotating member 208. Its other end 212*b* is fixed to the member 210 by being inserted into a hole 216 formed in the disc-like member 210. In relation to the spring clutch means 205, a clutch control means 218 shown in FIG. 10 is further disposed. With reference to FIG. 10, the clutch control means 218 has a nearly V-shaped control member 220 which is pivotally mounted on a supporting shaft 222 secured to the vertical rear base plate 16 (FIG. 8). A first stop piece 224 and a second stop piece 226 which project inwardly are formed respectively in the opposite end portions of the control member 220. One end portion of the control member 220 is connected to an output shaft 230 of an electromagnetic solenoid 228 fixed to the vertical rear base plate 16, and a compression spring member 234 is interposed between the solenoid body 232 of the electromagnetic solenoid 228 and one end portion of the control member 220. When the electromagnetic solenoid 228 in the clutch control means 218 is deenergized, the control member 220 is held at a first restraining position shown in FIG. 10 by the elastic biasing action of the compression spring member 234 (when the control member 220 is held at the first restraining position, the forward end of the first stop piece 224 formed in the control member 220 contacts the peripheral surface of the restrained rotating member 208). When the electromagnetic solenoid 228 is energized, the control member 220 is pivoted clockwise in FIG. 10 against the elastic biasing action of the spring member 234 and held at a second restraining position shown by two-dot chain lines in FIG. 10 (when the control member 220 is held at the second restraining position, the forward end of the second stop piece 226 formed in the control member 220 contacts the peripheral surface of the restrained rotating member 208). When the control member 220 is held at the first restraining position, the engaging claw 206 formed in the restrained rotating member 208 becomes engageable with the first stop piece 224 formed in the control member 220, as will be readily understood from FIG. 10. At this time, the second stop piece 226 formed in the control member 220 is deviated from the moving path of the engaging claw 206 formed in the restrained rotating member 208. When the engaging claw 206 engages the first stop piece 224, the restrained rotating member 208 is held at a first restrained angular position shown by solid lines in FIG. 10 [when the restrained rotating member 208 is held at the first restrained angular position, the rotating members 188 and 190 are held at the first angular position shown by the solid lines in FIG. 7, and the rollers 194 and 200 mounted on the rotating members 188 and 190 are held at first positioning recesses 240** formed on the upper ends of the rod members 196 and 204 (FIG. 7 shows only one first positioning recess 240 formed in the rod member 204)]. Thus, the rotation of the restrained rotating member 208 beyond the first restrained angular position is hampered. On the other hand, when the control member 220 is held at the second restraining position, the engaging claw 206 formed in the restrained rotating member 208 becomes engageable with the second stop piece 226 formed in the control member 220 as can easily be understood from FIG. 10. At this time, the first stop piece 224 formed in the control member 220 is deviated from the moving path of the engaging claw 206 formed in the restrained rotating member 208. Upon engagement of the engaging claw 206 with the second stop piece 226, the restrained rotating member 208 is held at a second restrained angular position shown by two-dot chain lines in FIG. 10 [when the restrained rotating member 208 is held at the second restrained angular position, the rotating members 188 and 190 are held at the second angular position shown by the two-dot chain lines in FIG. 7, and the rollers 194 and 200 mounted on the rotating members 188 and 190 are held at second positioning recesses 242 (FIG. 7 shows only one second positioning recess 242 formed in the rod member 204) formed in the upper ends of the rod members 196 and 204], and the rotation of the restrained rotating member 208 beyond the second restrained angular position is hampered.

The press-contacting control mechanism having the aforesaid structure further has a braking means 148 having substantially the same structure as the braking means 148 of the embodiment shown in FIGS. 1 to 6, as shown in FIG. 9. In the modified example, the roller 166 mounted on the oscillating member 152 is elastically pressed against the circumferential surface of the disc-like member 210 by the action of the tension coil spring 162.

The operation and advantages of the modified embodiment are nearly the same as those of the embodiment shown in FIGS. 1 to 6, and are therefore described below only briefly.

When the electromagnetic solenoid 228 is energized, the control member 220 is brought from the first restraining position shown by the solid lines in FIG. 10 to the second restraining position shown by the two-dot chain lines in FIG. 10. As a result, the coil spring 212 (FIG. 9) is contracted by the rotation of the gear 202 which is rotating in the direction of arrow 203 (FIG. 9) by the driving force from the driving source (not shown), and the disc-like member 210 is rotated. Furthermore, the restrained rotating member 208 is rotated via the coil spring 212 (at this time, the rotating members 188 and 190 fixed to the shaft 92 are also rotated). When the restrained rotating member 208 is rotated, the engaging claw 206 formed in the restrained rotating member 208 contacts the second stop piece 226 formed in the control member 220, as shown by the two-dot chain lines in FIG. 10. Thus, the restrained rotating member 208 is held at the second restrained angular position shown by the two-dot chain lines in FIG. 10. When the restrained rotating member 208 is held at this position, the rotating members 188 and 190 are held at the second angular position shown by the two-dot chain lines in FIG. 7. When the rotating members 188 and 190 are held at this position, the rollers 194 and 200 mounted on the rotating members 188 and 190 are held at the second positioning recesses 242 of the rod members 196 and 204. As a result, the positioning members 170 are held at the operating position shown by the two-dot chain lines in FIG. 7. Consequently, the movable supporting members 180 are held at the contacting position shown by the two-dot chain lines in FIG. 7 via the spring means 184, and by the action of the spring means 184, the follower fixing roller 6 is brought into press contact with the driven fixing roller 4 along its entire length (and the follower fixing roller 6 is held at the contacting position shown by the two-dot chain lines in FIG. 7).

When the electromagnetic solenoid 228 is deenergized, the control member 220 is brought from the second restraining position shown by the two-dot chain lines shown in FIG. 10 to the first restraining position shown by the solid lines in FIG. 10 by the action of the compression spring member 234. As a result, the coil spring 212 (FIG. 9) is contracted by the rotation of the gear 202 rotated in the direction of arrow 203 (FIG. 9), and the disc-like member 210 is rotated. Furthermore, the restrained rotating member 208 is rotated via the coil spring 212 (at this time the rotating members 188 and 190 fixed to the shaft 92 are also rotated). When the restrained rotating member 208 is rotated, the engaging claw 206 formed in the restrained rotating member 208 contacts the first stop piece 224 formed in the control member 220 as shown by the solid lines in FIG. 10, and consequently, the restrained rotating member 208 is held at the first restrained angular position shown by the solid lines in FIG. 10. When the restrained rotating member 208 is held at this position, the rotating members 188 and 190 are held at the first angular position shown by the solid lines in FIG. 7. When the rotating members 188 and 190 are held at this position, the rollers 194 and 200 mounted on the rotating members 188 and 190 are held at the first positioning recesses 240 formed in the rod members 196 and 204. Consequently, the positioning members 170 are held at the non-operating position shown by the solid lines in FIG. 7. As a result, the movable supporting members 180 are held at the non-contacting position shown by the solid lines in FIG. 7 via the spring means 184, and the follower fixing roller 6 is kept in rolling contact with the driven fixing roller 4 along its entire length (the follower roller 6 is held at the non-pressing position shown by the solid lines in FIG. 7).

When the electromagnetic solenoid 228 and the driving source are simultaneously deenergized, the follower fixing roller 6 is held at the non-contacting position in substantially the same way as in the embodiment shown in FIGS. 1 to 6 (at this time, the movable supporting members 180 are held at the non-pressing position; the positioning members 170, at the non-operating position; the rotating members 188 and 190, at the first angular position; and the restrained rotating member 208, at the first restrained angular position). Since in this modified embodiment, the first positioning recesses 240 and the second positioning recesses 242 are formed in the rod members 196 and 204, the positioning members 170 can be accurately held at the non-operating position in relation to the first angular position of the rotating members 188 and 190, and also at the operating position in relation to the second angular position of the rotating members 188 and 190.

Figure 11:
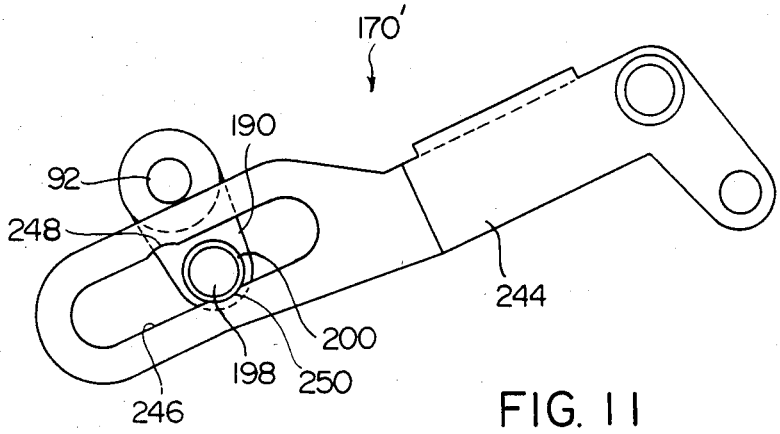
FIG. 11 is a view showing an enlarged view of a modified example of a positioning member.

In the above modified embodiment, the positioning member 170 having the rod member 204 is used. Instead, a positioning member shown in FIG. 11 may be used. With reference to FIG. 11, the positioning member 170′ has an oscillating body 244. An elongate hole 246 is formed in one end portion of the escillating body 244, and a first positioning recess 248 is formed in the upper surface defining the elongate hole 246. A second positioning recess 250 is formed in the lower surface defining the elongate hole 246. The roller 200 mounted on the rotating member 190 (or the roller 194 mounted on the rotating member 188) is disposed within the elongate hole 246 for free movement therealong.

When the positioning member 170′ is used, the roller 200 (or 194) is held at the first positioning recess upon the holding of the rotating member 190 (or 188) at the first angular position (when the roller 200 is held at this position, the positioning member 170′ is held at the non-operating position). Furthermore, when the rotating member 190 (or 188) is held at the second angular position, the roller 200 is held at the second positioning recess 250 formed in the elongate hole 246 (when the roller 200 is held at this position, the positioning member 170′ is held at the operating position).

While the toner image fixing device of this invention has been described in detail hereinabove with reference to the specific embodiments illustrated in the drawings, it should be understood that the invention is not limited to these specific embodiments, and various changes and modifications are possible without departing from the scope of the invention.

For example, in the illustrated embodiments, the braking means is comprised of an oscillating member, a tension coil spring, and a roller. It may, however, be constructed of a torsion coil spring. In this alternative, a braking force is exerted on the positioning member 170, for example, by mounting the torsion coil spring on the supporting shaft on which the positioning member is mounted, and connecting its one end to the positioning member and its other end to the vertical front base plate (or the vertical rear base plate).

Furthermore, in the illustrated embodiments, the follower fixing roller is held at the contacting position and the non-contacting or non-pressing position by moving both end portions of the follower fixing roller. The invention, however, can also be applied to a toner image fixing device of the type in which one end portion of the follower fixing roller is moved to hold it at the contacting position and the non-contacting or non-pressing position (therefore, when the follower fixing roller is held at the non-contacting or non-pressing position, it is kept out of press contact with the driven fixing roller along at least a greater portion of its length, viz., the former is kept away from, or in rolling contact with, the latter).

What we claim is:

1. A toner image fixing device comprising:

a rotatably mounted driven fixing roller drivingly connected to a driving source;

a rotatably mounted follower fixing roller;

a movable supporting member having mounted thereon at least one end of said follower fixing roller, said movable supporting member being mounted for free movement between a contacting position at which said follower fixing roller is kept in press contact with said driven fixing roller and a non-contacting position at which at least a greater portion of the longitudinal length of said follower fixing roller is maintained out of press contact with said driven fixing roller;

a press-contacting control mechanism for selectively holding said movable supporting member at said contacting position and at said non-contacting position;

said control mechanism including a positioning member connected to said movable supporting member through a spring means and mounted for free movement between an operating position, whereat said movable supporting member is moved to said contacting position and said follower fixing roller is brought into press contact with said driven fixing roller by the elastic biasing action of said spring means, and a non-operating position, whereat said movable supporting member is moved to said non-contacting position through the spring means;

actuating means for selectively holding said positioning member at said operating position and said non-operating position, said including a rotating input element drivingly connected to said driving source, a rotatably mounted cam element, spring clutch means interposed between said rotating input element and said cam element, and clutch control means adapted to be selectively held at a first restraining position and a second restraining position, such that when said clutch control means is moved from said first restraining position to said second restraining position, the rotation of said rotating input element is transmited to said cam element through said spring clutch means to rotate said cam element from a first angular position to a second angular position and said cam element acts on said positioning member to move it to said operating position, and when said clutch control means is moved from said second restraining position to said first restraining position, said cam element is rotated from said second angular position to said first angular position and said positioning member is moved to said non-operating position; and an electromagnetic solenoid energizable to move said clutch control means to said second restraining position and deenergizable to move said clutch control means to said first restraining position, said electromagnetic solenoid being deenergized to thereby maintain said movable supporting member in said non-operating position at least while said driving source is deenergized.

2. A device as claimed in claim 1, wherein said spring clutch means comprises a rotatably mounted restrained rotating member, and a coil spring fitted over a hub portion rotating as a unit with said cam element and a hub portion rotating as a unit with said rotating input element and being wound from a first end thereof connected to said restrained rotating member to a second end thereof connected to said cam element in a direction such that is contracts when said rotating input element is rotated in a predetermined direction by said driving source; and wherein the clutch control means hampers at said first restraining position the rotation of said restrained rotating member in said predetermined direction beyond a first restrained angular position corresponding to said first angular position of said cam element, and hampers at said second restraining position the rotation of said restrained rotating member in said predetermined direction beyond a second restrained angular position corresponding to said second angular position of said cam element.

3. A device as claimed in claim 1, wherein said pressure-contacting control mechanism includes a braking means for braking the rotation of said cam element.

4. A device as claimed in claim 3, wherein the rotation braking force exerted on said cam element by said braking means is smaller than the elastic rotating force exerted on said cam element by said spring means.

5. A device as claimed in claim 1, wherein said follower fixing roller is made of a flexible material.

6. A device as claimed in claim 1, wherein said driven fixing roller has therein an electrical heating element.

* * * * *